US005249526A

United States Patent [19]

Cooksey

[11] Patent Number: 5,249,526

[45] Date of Patent: Oct. 5, 1993

[54] SAFE AND ARM DEVICE

[75] Inventor: George E. Cooksey, Ridgecrest, Calif.

[73] Assignee: The United States of America as represented by the Secretary of the Navy, Washington, D.C.

[21] Appl. No.: 975,034

[22] Filed: Nov. 12, 1992

[51] Int. Cl.[5] ..... F42C 15/40; F42C 15/24; F42C 15/34

[52] U.S. Cl. ..... 102/255; 102/248; 102/262; 102/264

[58] Field of Search ..... 102/248, 254, 255, 256, 102/264, 262

[56] References Cited

U.S. PATENT DOCUMENTS

| | | | |
|---|---|---|---|
| H453 | 4/1988 | Schmidlin | 102/254 |
| H593 | 3/1989 | Cooksey et al. | 102/248 |
| 3,306,207 | 2/1967 | Becker et al. | 102/254 |
| 3,776,138 | 12/1973 | Moses | 102/248 |
| 3,994,231 | 11/1976 | Rudeen et al. | 102/263 |
| 4,019,441 | 4/1977 | Morgen et al. | 102/262 |
| 4,046,076 | 9/1977 | Hampton | 102/262 |
| 4,240,351 | 12/1980 | San Miguel | 102/262 |
| 4,320,389 | 3/1982 | Caruso | 102/262 |
| 4,337,701 | 7/1982 | Janson | 102/264 |
| 4,346,658 | 8/1982 | Hibbs et al. | 102/254 |
| 4,359,942 | 11/1982 | Schmidlin | 102/263 |
| 4,407,201 | 10/1983 | Jenson | 102/264 |
| 4,478,147 | 10/1984 | Hennings et al. | 102/255 |
| 4,489,656 | 12/1984 | Hennings et al. | 102/254 |
| 4,592,281 | 6/1986 | Nagennast | 102/254 |
| 4,615,269 | 10/1986 | Holder | 102/221 |
| 4,635,552 | 1/1987 | Battle | 102/254 |
| 4,736,175 | 4/1988 | Cooksey | 335/230 |
| 4,896,607 | 1/1990 | Hall et al. | 102/254 |

*Primary Examiner*—David H. Brown

*Attorney, Agent, or Firm*—Stephen J. Church; Melvin J. Sliwka; John L. Forrest, Jr.

[57] ABSTRACT

A safe and arm device has a cylindrical body from which a plurality of explosive leads diverge from a rotor movable through an arming angle to electrically and mechanically arm a plurality of detonators and has a rotary solenoid with a shaft oscillating a predetermined number of times when the device is to assume an armed condition. The device has an axle extending alongside the shaft, and a setback weight is mounted on and helically coupled to the axle to motivate the axle through an angle actuating the rotor through the arming angle. The shaft bears an arcuate pawl having recesses, and the axle bears an arcuate cam having recesses juxtapositioned to the pawl. Latch balls are mounted in the body between the pawl and cam for movement partially into and from the recesses. The pawl recesses are configured so that the balls are alternately motivated toward and from the cam by the oscillations, and the cam recesses are configured so that alternating engagement and disengagement by the balls releases the shaft, when motivated by the weight, to move through the actuating angle in steps corresponding to the oscillations. The cam recesses and rotor actuation are arranged to allow the device to be resafed, to be locked in both safe and armed conditions, and to minimize any intermediate condition.

8 Claims, 5 Drawing Sheets

SAFE AND ARM DEVICE

BACKGROUND OF THE INVENTION

1. Field of the Invention

This invention pertains to the field of igniting devices for ammunition and explosives. More particularly, it pertains to such a device having a slide or rotor controlled by a logic device.

2. Description of the Prior Art

Safe and arm devices, such as that of United States Statutory Invention Registration H593, are known to arm by energy provided by acceleration in a predetermined direction acting on a setback weight and released in a series of steps by an electromechanical escapement having a member oscillated a predetermined number of times when arming is to occur. Such devices provide effective interlocks against both mechanical failure and failure of electronic logic providing pulses to a device, such as the rotary solenoid of U.S. Pat. No. 4,736,175, driving the oscillating member. It is also known, as in U.S. Pat. No. 4,240,351, to provide a safe and arm device with a rotor arming a plurality of detonators by electrical switching and by explosive lead positioning. It is preferable that a safe and arm device be adapted, as in U.S. Pat. No. 4,489,656, for testing by repeated cycles of arming followed by resafing.

Typically, a safe and arm device has an arming element with a safe position where one portion of an explosive train is out of alignment with other portions of the train, and movement of the element to an armed position aligns the train portions to transmit an explosion. However, when the explosive train portions are partially aligned as the element approaches the armed position, the device is in an indeterminate condition where the device is not safe and yet may not transmit the explosion. The possibility of the device being in such an indeterminate condition is, typically, minimized by releasing the arming element from logic elements controlling its movement and motivating the element rapidly, as by a spring, into the armed position. However, the element cannot then be further controlled or returned to the safe position by the logic elements. To further prevent the device being in such an indeterminate condition, it is known to positively lock the arming element in its safe and its armed positions.

It is highly desirable to provide a safe and arm device having such safety and arming features applied to multiple detonators. However and insofar as known to the applicant, there is no such prior art device of compact and rugged construction because of the problems of excessive bulk and operating forces required for effective safing of multiple detonators while providing the necessary interlocks, arrangements for resafing, and volume required for a rotary solenoid and associated electronic logic device.

SUMMARY AND OBJECTS OF THE INVENTION

A safe and arm device has a cylindrical body with a plurality of diverging explosive paths and a plurality of detonators at one end; has a rotor movable from a safe position to an armed position through an arming angle to electrically arm the detonators and position explosive leads from the detonators to the paths; and has a rotary solenoid with an output shaft oscillating a predetermined number of times when the solenoid is energized to cause the device to assume an armed condition. The device has an axle extending alongside the shaft and drivingly connected to the rotor. A setback weight is mounted for movement along the axle and is helically coupled thereto so as to motivate the axle to pivot through an angle actuating the rotor through the arming angle as the weight moves from an initial position. A pair of latch balls are mounted in the body between the shaft and the axle and are spaced axially thereof. The balls are moveable between an arcuate pawl oscillating with the shaft and an arcuate cam moving with the axle. The pawl has a pair of recesses configured so that the balls are alternately motivated toward and from the cam by the oscillations, and the cam has a pair of rows of angularly spaced recesses configured so that alternating engagement and disengagement of the balls therein releases the shaft, when motivated by the weight, to move through the actuating angle in steps corresponding to the oscillations. The recesses and the connection of the axle to the rotor are configured to lock the rotor in the safe position and the armed position and to provide more rapid movement of the rotor through the arming angle as the rotor nears the armed position, and the weight is resiliently urged toward its initial position for resafing of the device when the solenoid is suitably energized.

It is an object of the present invention to provide a safe and arm device which is for a plurality of detonators, is receivable in a limited volume, and is armed by an electronically predetermined sequence of movements of an oscillating member during a predetermined acceleration.

Another object is to provide such a safe and arm device which requires minimal forces for its operation and yet is effectively locked in both the safe and the armed conditions and is dependably armed only by predetermined setback forces.

Still another object is to provide such a safe and arm device which has interlocks against electrical and mechanical failure, is adapted for testing by repeated arming and resafing, and has minimal time in any indeterminate condition between the safe and armed conditions.

Yet another object is to provide a safe and arm device which has the above and other advantages and is rugged and fully effective.

BRIEF DESCRIPTION OF THE DRAWINGS

Other objects, advantages, and novel features of the present invention will be apparent from the following detailed description when considered with the accompanying drawings wherein.

Figure 2:
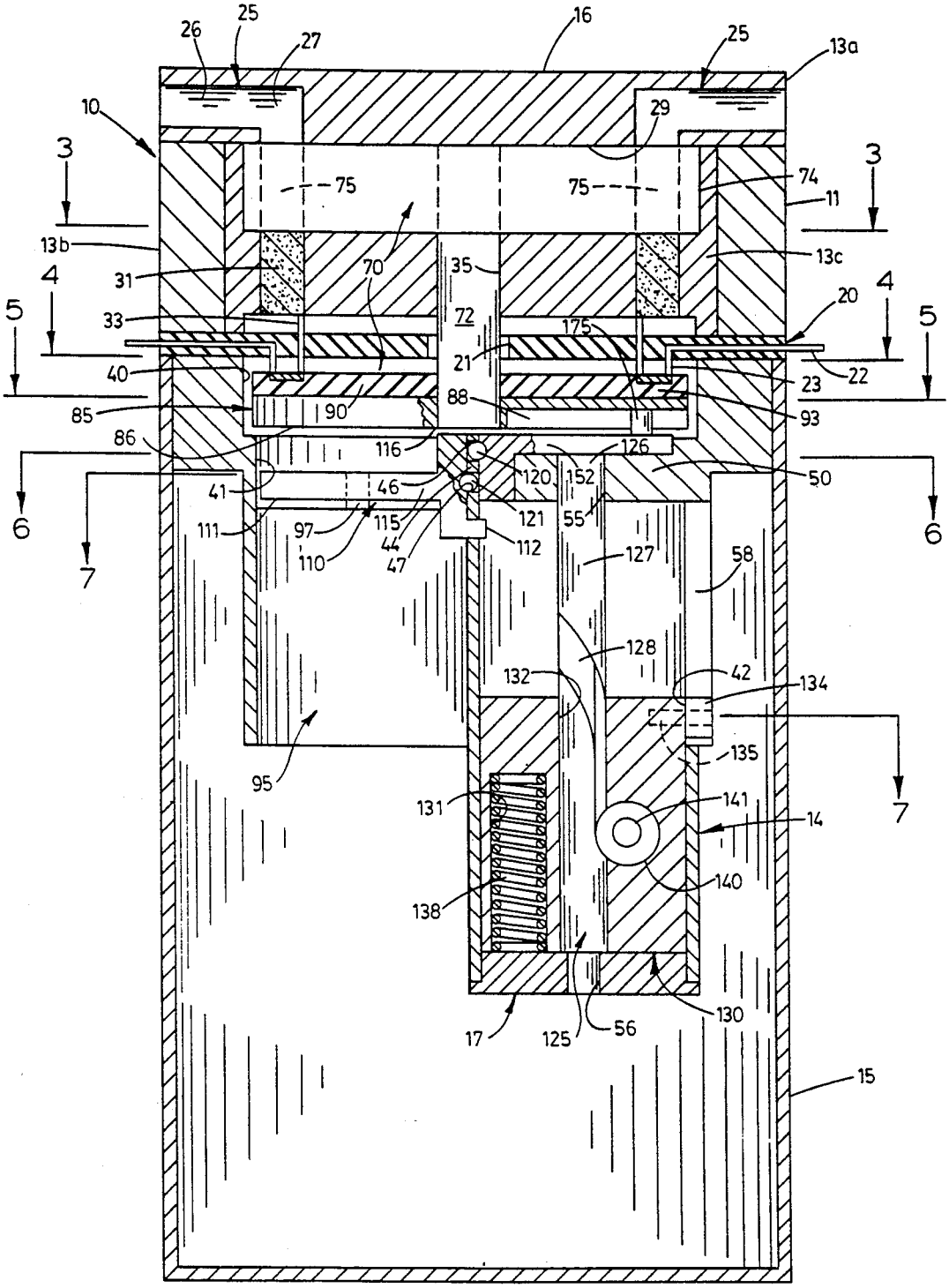
FIG. 2 is a axial section of the device of FIG. 1 in an assembled and armed condition.
Figure 6:
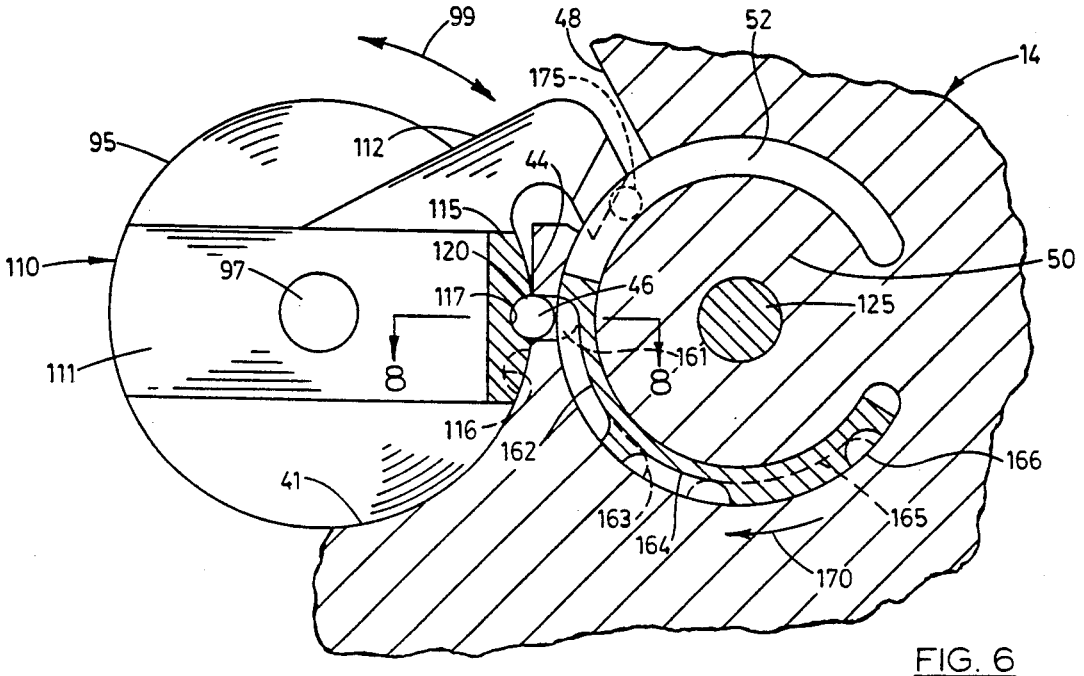
Figure 7:
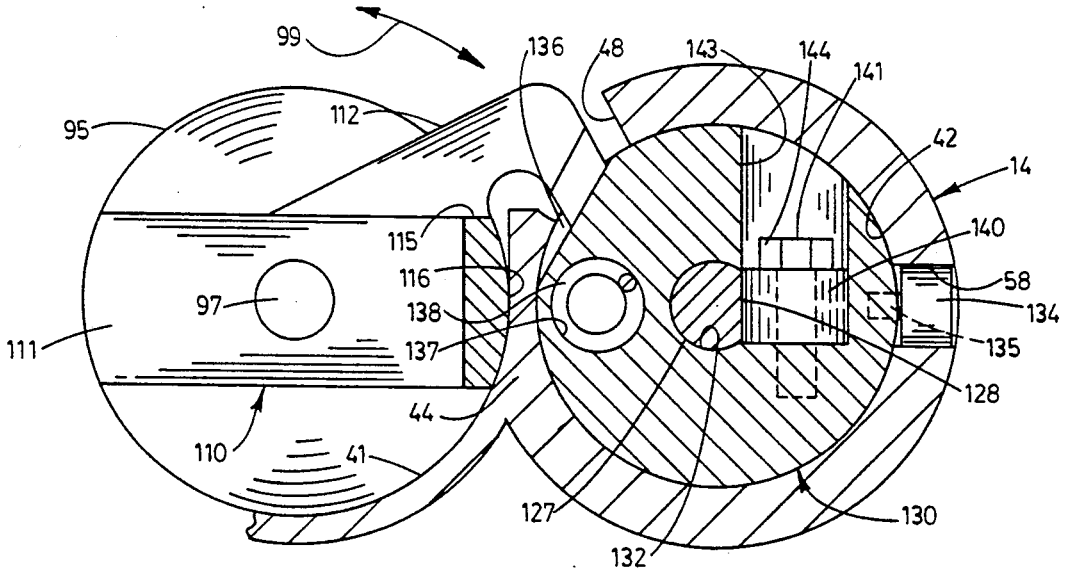
Figure 8:
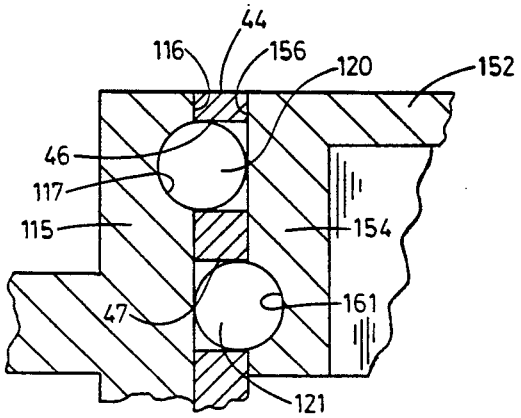
Figure 9:
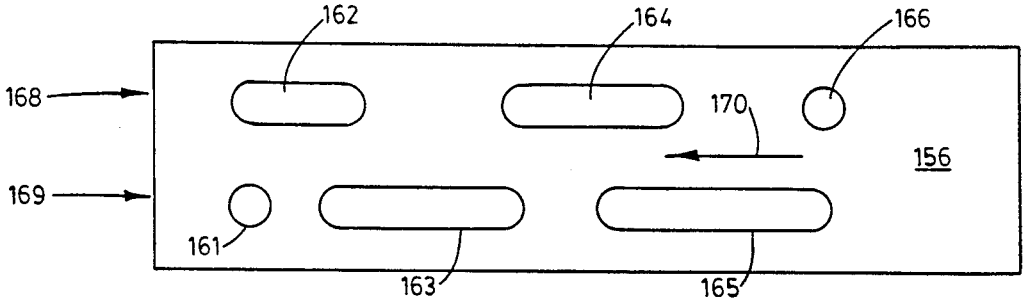

FIG. 6 is a fragmentary, diametrical section of the device taken from the position of line 6—6 of FIG. 2 and at an enlarged scale and showing a ball latched escapement arrangement including an arcuate pawl and an arcuate cam;

FIG. 7 is a fragmentary, diametrical section of the device at the enlarged scale and taken from the position of line 7—7 of FIG. 2 but in the safe condition and showing an inertia weight and unlatching, spring, and helical driving arrangements associated with the weight;

FIG. 8 is a fragmentary section of the device taken on line 8—8 of FIG. 6 and at the enlarged scale and in said safe condition; and FIG. 9 is a developed view of the periphery of an arcuate cam surface of the device.

DETAILED DESCRIPTION

Figure 1:
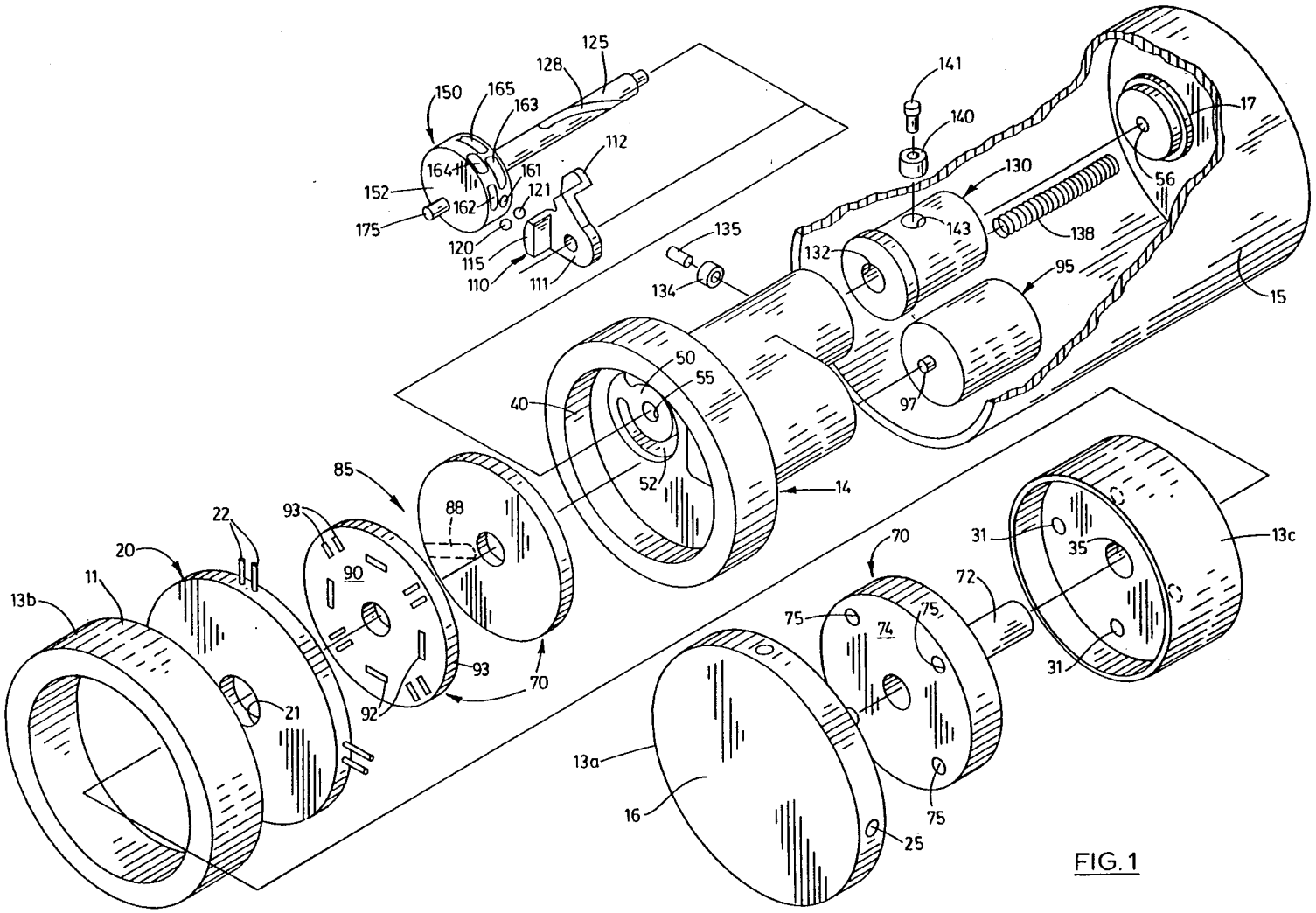
FIG. 1 is an exploded view of a safe and arm device embodying the principles of the present invention, the elements of the device being in positions corresponding to a safe condition of the device.

FIGS. 1 and 2 show a safe and arm device embodying the principles of the present invention and having a body 10 receivable in a fuze well or the like, not shown. Body 10 has a cylindrical periphery 11, has a detonator axial end portion separably formed in three . sections 13*a*–13*c*, and has an opposite drive end portion 14 which, typically, is within a canister 15. End portion section 13*a* and end portion 14 are depicted as terminating axially of periphery 11 in respective planar surfaces 16 and 17.

Body 10 is constructed of any suitable material, but has a disk 20 of electrically insulating material disposed between end portion sections 13*b* and 13*c* and end portion 14. Disk 20 has a central opening 21 and is provided with four pairs of electric connectors 22 extending radially from disk 20 for connection within the fuze well for purposes subsequently explained. Each connector 22 extends from periphery 11 within disk 20 and then axially therefrom toward body portion 14 to terminate in a contact 23. Disk 20, connectors 22, contacts 23 and other electrical elements yet to be described are part of a typical safe and arm device and may be lacking or otherwise arranged in other embodiments of the present invention. Suitable arrangements for assembly and mechanical connection of the various elements of the device are not portions of the invention; are believed readily apparent to one skilled in the art; and, accordingly, are omitted for clarity.

Figure 3:
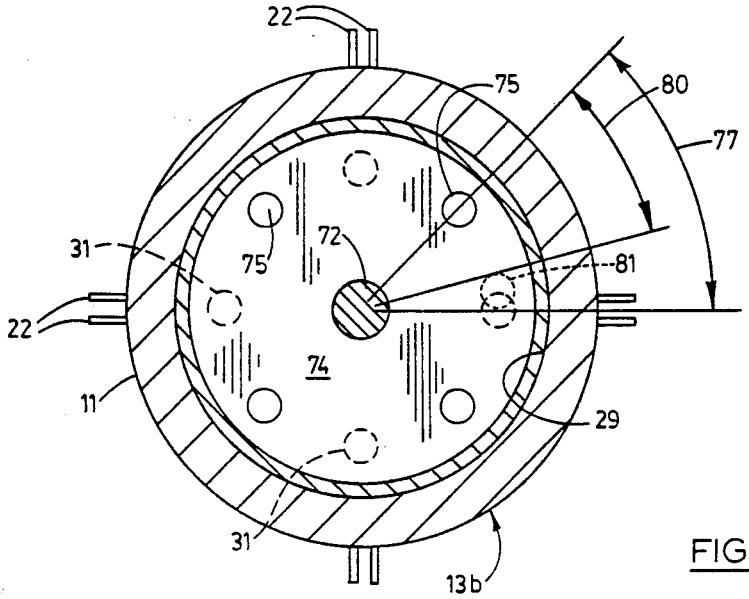
FIG. 3 is a diametrical section of the device showing a rotor with explosive train elements and taken on line 3—3 of FIG. 2, the rotor being positioned as in said safe condition and an intermediate position of one of the elements being indicated by a dot circle.

As shown in FIGS. 1 and 2 and in dash circles in FIG. 3, detonator end portion section 13*a* has four explosive paths 25 equally angularly spaced within periphery 11. Each path has an arm 26 opening radially outwardly of detonator portion 13 toward a continuation, not shown, of the path in the fuze well, and has a 27 opening oppositely of surface 16 toward a circular recess 29 in body section 13*c* of 10. Recess 29 is somewhat smaller in diameter than periphery 11 and is coaxial therewith. Body 10 receives four detonators 31, each detonator being disposed oppositely of recess 29 from a corresponding explosive path arm 27 and extending from this recess nearly to insulator disk 20. Each detonator has a pair of electrical initiating leads 33 extending through disk 20, each lead 33 terminating adjacent to a contact 23. Body end portion section 13*c* has a bearing bore 35 coaxial with periphery 11 and extending centrally of detonators 31 from recess 29 toward opening 21 in disk 20.

Drive portion 14 of body 10 is shown in FIGS. 1, 2, and 5–7 and has a cylindrical recess 40 which is adjacent to insulating disk 20, somewhat smaller in diameter than periphery 11, and coaxial therewith. Portion 14 has a solenoid bore 41 and a weight bore 42 extending alongside each other in parallel relation from recess 40 toward end surface 17. Bores 41 and 42 have diameters nearly one-half that of periphery 11, are parallel to the axis thereof, and are separated by a wall 44 which is integrally constructed with the balance of body portion 14 and has opposite, arcuate sides best shown in FIG. 6 and corresponding to bores 41 and 42. Wall 44 has a first ball receiving bore 46 and a second ball receiving bore 47 extended through this wall and radially between bores 41 and 42. Bores 46 and 47 are somewhat larger in diameter than the distance axially thereamong between bores 41 and 42 and are spaced axially of bores 41 and 42, bore 46 being adjacent to recess 40 and bore 47 being adjacent to bore 46 and spaced somewhat therefrom oppositely of recess 40. Wall 44 also has an opening 48, shown in FIGS. 1, 6, and 7 between bores 41 and 42, this opening extending from recess 40 along bores 41 and 42 at one side of bores 46 and 47.

Drive portion 14 includes a bearing arm 50 shown in FIGS. 1, 2, and 6. Arm 50 extends across the end of weight bore 42 which is toward recess 40 and extends from the side of bore 42 opposite wall 44, terminating in a distal end at the center of bore 42. Arm 50 extends axially of weight bore 42 from about the center of bore 46 to the bore 47 side which is opposite bore 46. Arm 50 is configured so that its distal end defines an arcuate slot 52 extending about 300 degrees about this distal end as best shown in FIG. 6, and the distal end of arm 50 has a bearing bore 55 coaxial with weight bore 42. At the end of weight bore 42 opposite recess 40, body portion 14 is provided with a bearing bore 56 coaxial with bore 55. This body portion has a guide groove 58 extending axially along weight bore 42 at the side thereof opposite solenoid bore 41.

The safe and arm device has a rotor indicated generally by numeral 70 and shown in FIGS. 1–5. The rotor has a shaft 72 mounting the rotor in body 10 for pivotal movement coaxially with periphery 11. Shaft 72 is received in bearing bore 35 and extends from recess 29 of detonator end portion section 13*c* through bore 35 and through opening 21 in insulating disk 20 into recess 40 of body driving portion 14. Rotor 70 includes a disk 74 fixed to shaft 72 and closely but pivotally fitted in recess 29. Disk 74 is provided with four explosive leads 75 which are spaced about the disk so as to be fully aligned between detonators 31 and arms 27 of explosive paths 25 when rotor 70 is in an armed position shown in FIG. 2. Rotor 70 also has a safe position shown in FIGS. 3–5 in which leads 75 are not aligned with paths 25 and detonators 31. To attain the armed position from the safe position, the rotor pivots through an arming angle of about 45 degrees, this angle being indicated by arcuate arrows 77 in FIGS. 3–5.

From FIG. 3 it is evident that, when rotor 70 is pivoted from the safe position toward the armed position through an angle indicated by arrow 80, the rotor is in an intermediate position wherein, as indicated by a dot circle 81 representing the position of one of the leads 75 when the rotor is in the intermediate position, each of these leads is partially aligned with the corresponding one of the detonators 31. It is also evident that the intermediate position is adjacent to the armed position and that, in the intermediate position, leads 75 are also partially aligned with the corresponding explosive path arms 27 which are not shown in FIG. 3, but which, as seen in FIG. 2 are aligned with the corresponding detonators.

Rotor 70 includes a driving disk 85 fixed to shaft 72 and disposed in recess 40. Disk 85 has a side 86 juxtapositioned to wall 44 and defining a driving slot 88 shown in FIGS. 2 and 5 and extending radially of this disk. Slot 88 is disposed at the axis of weight bore 42 when the rotor is in the FIG. 2 armed position, and slot 88 is disposed at the arming angle 77 from the bore 42 axis when the rotor is in the FIG. 5 safe position.

Figure 4:
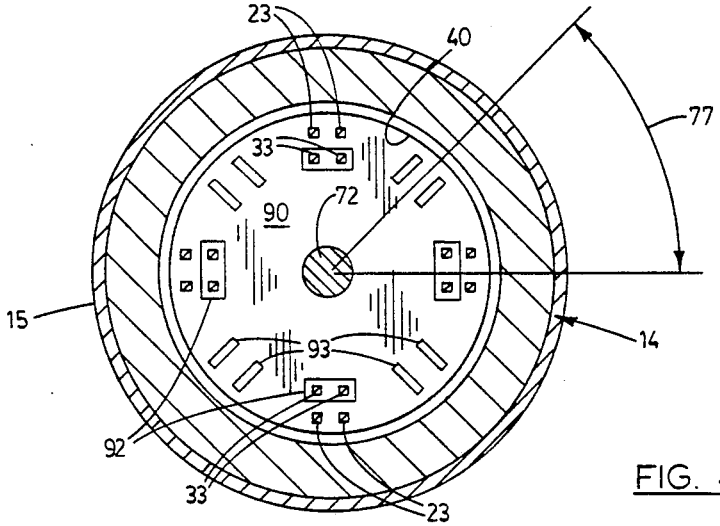
FIG. 4 is a diametrical section of the device in the safe condition showing electrical safe and arm switches and taken on line 4—4 of FIG. 2.

Rotor 70 may be provided with elements, which are not a portion of the present invention, for electrically safing and arming detonators 31. Typical such elements are shown in FIGS. 1, 2, and 4 and include a layer 90 of insulating material applied to the side of driving disk 85 toward insulating disk 20. Layer 90 bears four contact strips 92 disposed so as to short together detonator leads 33 when the rotor is in the FIG. 4 safe position. Layer 90 also bears four pairs of contact strips 93 disposed so that, in the FIG. 2 armed condition, strips 93 connect the detonator leads individually to the contacts 23 and thus to the connectors 2 extending externally from body 10.

The safe and arm device has a rotary solenoid 95 mounted in bore 41 at the end thereof at 17. The solenoid has an output shaft 97 extending along the axis of bore 41. Shaft 97 is coaxially disposed in bore 41 and extends therein toward driving disk 85 of rotor 70. Solenoid 95 is characterized by being constructed so that shaft 97 oscillates a predetermined number of times when the solenoid is energized by any suitable electronic logic circuits, which may be of well-known construction and are, therefore, not shown. Such circuits provide electrical pulses to the solenoid to cause the safe and arm device to assume an armed condition by pivotal movement of rotor 70 from its above-described safe position to its armed position. For illustrative purposes, the described embodiment is depicted as utilizing a sequence of four pivotal movements. Each movement is about 30 degrees as indicated by arrows 99 in FIGS. 6 and 7, and successive movements are in opposite directions. These pivotal movements correspond, as subsequently described in detail, to successive steps or angular movements 101–104, indicated in FIG. 5, of rotor 70 between its safe and its armed positions.

The safe and arm device has a pawl or first cam 110 shown in FIGS. 1, 2, and 6–8 and mounted oh shaft 97 for pivotal oscillation therewith. Pawl 110 has a plate 111 extended transversely of bore 41 and fixed centrally to shaft 97. The pawl has a latch arm 112 of hook-like configuration as best seen in FIG. 7. Arm 112 extends from plate 111 through body opening 48 and into weight bore 42 when shaft 97 and pawl 110 are in a first position shown in FIG. 6 and 8 and corresponding to their position prior to the initial pivotal movement of the sequence thereof causing movement of rotor 70 to its armed position. The shaft and pawl have a second position which is shown in FIG. 2 and in which arm 112 is pivoted from bore 42, this second position being attained at the end of such initial movement which is counter-clockwise along arrows 99 in FIGS. 6 and 7.

Pawl 110 has an plate 115 extending from plate 112 axially of bore 41 and across bores 46 and 47. Plate 115 bears an arcuate surface 116 coaxially related to the axis of shaft 97, juxtapositioned to bores 46 and 47, and conforming to the side of bore 41. Surface 116 defines a pair of recesses 117 and 118 which are of spherical section with a depth somewhat less than less than half the diameter of bores 46 and 47 and which are sometimes referred to in the claims as "first recesses". Axially of shaft 97, recess 117 is disposed for alignment with bore 46 with recess 118 being disposed for alignment with bore 47. These recesses are disposed angularly of surface 116 so that recess 117 is aligned with bore 46 in the above-described initial position of pawl 110 and so that recess 118 and bore 47 are aligned in the above-described second position of the pawl.

The safe and arm device has a pair of escapement elements or latch balls 120 and 121 individually and rollably received in, respectively, bores 46 and 47 of body portion 14. Ball 120 thus corresponds to pawl recess 117 and ball 121 corresponds to pawl recess 118. It is evident that bores 46 and 47 mount the latch balls in spaced relation along any elements extended along the axes of solenoid bore 41 and weight bore 42, and that bores 46 and 47 mount the balls for movement radially toward and from elements so extended.

As shown in FIGS. 1, 2, 6, and 7, the safe and arm device has an axle or actuating shaft 125 extending along the axis of weight bore 42 through bore 55 in arm 50 and through bore 56 so that the axle is mounted on body portion 14 for pivotal movement relative thereto about the weight bore axis. Axle 125 has an end 126 extending from bore 55 toward driving disk 80 of rotor 70 and terminating adjacent to side 81 of this disk. It is evident that the axle extends from its end 126 alongside solenoid output shaft 97 in parallel relation thereto. Between bores 55 and 56, the periphery of axle 125 bears a cylindrical first surface 127 and bears a helical second surface 128 which is contiguous with the cylindrical surface and which is twisted about 135 degrees about the axle axis. The helical surface is characterized by having elements parallel to a diameter of the cylindrical surface and intersecting a cylindrical helix which is somewhat smaller in diameter than the cylindrical surface and which is coaxially related thereto.

The safe and arm device has a setback weight indicated generally by numeral 130, shown in FIGS. 1, 2, and 7, and disposed in bore 42 of body portion 14. Weight 130 is depicted in FIG. 2 in a position in bore 42 adjacent to bore 56 and corresponding, as subsequently described in detail, to the armed position of rotor 70. In FIG. 7, the weight is depicted in another position which corresponds to the safe position of rotor 70. Although not specifically shown, in this latter position the weight is disposed in bore 42 adjacent to arm 50. The weight has a bore 132 extending centrally through the weight and slidable fitted to cylindrical surface 127 of axle 125, this surface extending through bore 132 so that the weight is mounted on body portion 14 by axle 125 for inertial motivated movement thereamong in a direction between bearing bores 55 and 56. Weight 130 has a cylindrical periphery somewhat smaller in diameter than bore 42 and provided with a guide roller 134 received in guide groove 58 and mounted on the weight, as by a pin 135, for rotation about an axis normal to axle 125 and extending into the guide groove so that the guide groove and roller prevent rotation of the weight about axle 125 and in relation to body portion 14. The periphery of weight 130 has .a recess 136 shown in FIG. 7 and disposed for engagement by weight latching arm 112 of pawl 110 when this pawl is in its above-described first position and the weight is in its FIG. 7 position, arm 112 being pivoted from recess 136 when the pawl moves to its above-described second position. Weight 130 has a bore 137 in its end toward bore 56, and this bore receives a helical compression spring 138 which shown in a fully compressed state in FIG. 2 and which urges the weight toward bore 55.

Figure 5:
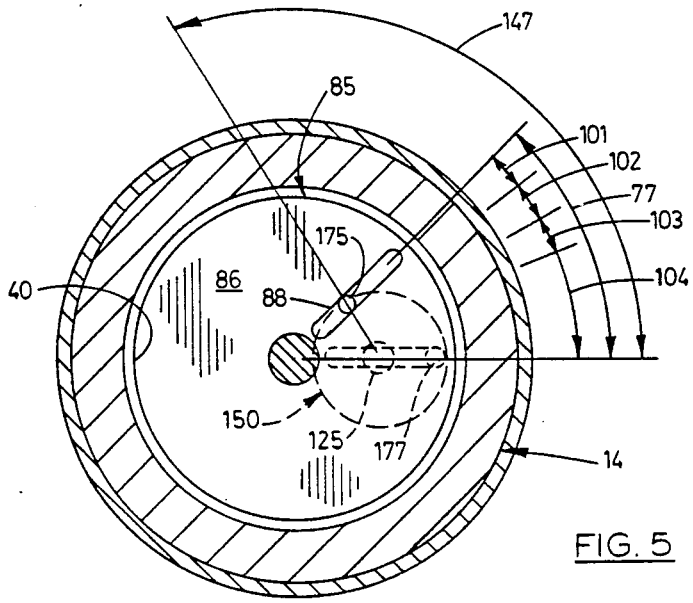
FIG. 5 is a diametrical section of the device in the safe condition showing driving arrangements of the rotor and taken from the position of line 5—5 of FIG. 2 with indicia added to show angulular positions of the rotor.

Weight 130 is provided with a drive roller 140 mounted thereon, in any suitable manner as by a pin 141, for rotation relative to the weight about an axis parallel to a diameter of cylindrical surface 127 of axle 125. The drive roller has a cylindrical periphery which engages helical surface 128 of axle 125 as shown in FIGS. 2 and 7. As shown in FIG. 7, roller 140 may be disposed in the weight and in a bore 143 thereof partially intersecting central bore 132, bore 143 being coaxial with the roller and the roller being retained by a head 144 of the pin. It is evident that movement of weight 130 along axle 125 for a distance such that roller 140 traverses helical surface 128 drives the axle pivotally through an actuating angle which is about 135 degrees and is indicated in FIG. 5 by arrow 147. Helical surface 128 is arranged so that, when the safe and arm device is subject to acceleration in a direction along the axle from surface 17 toward surface 16, inertia of the weight urges it to move relative to body 10 in the opposite direction to such acceleration and motivate the axle to pivot through angle 147 in a direction clockwise in FIGS. 5–7, the same direction rotor 70 moves from its safe position to its armed position. Helical surface 128 is also arranged so that spring 138 urges the weight to move along the axle in a direction from bore 56 toward bore 55 and motivate the axle to turn through angle 147 in a direction counter-clockwise in FIGS. 5–7.

The safe and arm device has a second cam 150 which is shown in FIGS. 1, 2, 5, 6, 8, and 9 and which is mounted on end 126 of axle 125 for pivotal movement therewith through actuating angle 147. Cam 150 has a circular plate 152 of about the diameter of bore 42, fixed coaxially on axle end 126, and disposed in body portion 14 recess 40. One side of plate 152 is juxtapositioned to side 81 of rotor disk 80 and the opposite side of the plate is juxtapositioned to bearing arm 50 oppositely of weight 130. Cam 150 has an arcuate plate 154 extending from plate 152 axially of bore 42 through arcuate slot 52 and across bores 47 and 48. Plate 154 bears an arcuate surface 156 juxtapositioned to bores 46 and 47, conforming to the side of bore 42, and coaxially related to the axis of axle 125. As best shown in FIG. 6 in which plate 154 and surface 156 are shown in a first position of cam 150 corresponding to the safe position of rotor 70, this plate and surface extend accurately about this axis for an angle substantially one half of the angle occupied by slot 52. Cam 150 has a second position which corresponds to the armed position of rotor 70 and in which plate 154 with its surface 156 is pivoted substantially 135 degrees in a direction clockwise in FIG. 6 from the position shown therein.

Surface 156 defines six recesses 161–166 which are best shown in FIGS. 2, 6, 8, and 9; are of spherical or circular section with a depth somewhat less than less than half the diameter of bores 46 and 47; and are sometimes referred to in the claims as "second recesses". As best shown in FIGS. 8 and 9, recesses 162, 164, and 166 are angularly spaced on surface 156 in a row 168 disposed axially of axle 125 for alignment with bore 46. Recesses 161, 163, and 165 are similarly spaced on surface 156 in a row 169 disposed for alignment with bore 47. It is apparent that row 168 is juxtapositioned to recess 117 of pawl 110 and corresponds to ball 120, and it is apparent that row 169 is juxtapositioned to recess 118 of pawl 110 and corresponds to ball 121.

Recess 161 is of spherical section and is disposed for alignment with bore 47 when cam 150 is in its above-identified first position. Recess 166 is also of spherical section and is disposed for alignment with bore 46 when cam surface 156 has pivoted, in the direction indicated in FIGS. 6 and 9 by arrows 170 and with cam 150, from this first position of this cam into the above-described second position thereof. Recesses 162–165 are elongated accurately for predetermined angles along surface 156 and correspond, respectively and as subsequently described, to steps 101–104 of rotor 70.

Cam 150 bears a pin 175, shown in FIGS. 2 and 5 and at a position indicated by a dot circle in FIG. 6, for connecting the cam, and thus end 126 of axle 125, to rotor 70 for driving the rotor through its arming angle 77 as the axle pivots through its actuating angle 147. Pin 175 extends from plate 152 parallel to axle 125 into slidable and driving relation with driving slot 88 of rotor 70 so that, when axle 125 moves pivotally, engagement of the pin with a side of slot 88 drives rotor 70 pivotally. Pin 175 is disposed on cam 150 so that, when the rotor is in its safe position and the cam and axle are correspondingly positioned as shown in FIG. 5, the pin is on a radius from the axle substantially normal to slot 88. The disposition of pin 175 is also such that, when the rotor is in its armed position and the cam and axle are correspondingly positioned as shown in FIG. 2 and indicated by dash-dot lines and numeral 177 in FIG. 5, slot 88 is substantially coincident with a radius from axle 125. It is apparent that, as a result of this change in angular relation between slot 88 and such a radius, pin 175 drives rotor 70 through arming angle 77 at an angular rate that increases as the rotor moves through angle 80 and approaches its above-described intermediate position, which is indicated by dot circle 81 in FIG. 3, and as the rotor moves toward its armed position from this intermediate position.

OPERATION

The operation of the described safe and arm device embodying the present invention will now be briefly described with directions of movement and the like being in relation to the Figures. The description will begin with the device undergoing acceleration in a direction from surface 17 toward surface 16 and the elements of the device in positions corresponding to the safe position of rotor 70, these element positions including setback weight 130 being adjacent to arm 50 and pawl 110 being disposed as in FIGS. 6 and 7. With the device in this condition, setback weight 130 is retained adjacent to arm 50 by reception of arm 112 in recess 136 so that the weight cannot motivate axle 125 to pivot and drive rotor 70 toward its armed position. Pivoting of axle 125 is further prevented by ball 121 being received in spherical section recess 161 of cam 150 to lock cam 150 against any pivotal movement, ball 121 being so received since pawl surface 116 urges ball 121 fully through bore 47 into recess 161 as shown in FIG. 8.

When the safe and arm device is to be armed by pivoting of rotor 70 to its armed position, solenoid 95 receives a first pulse causing shaft 97 and pawl 110 to pivot counter-clockwise through angle 99 and withdraw arm 112 from recess 136 allowing inertial force acting on weight 130 to urge the weight somewhat along axle 125 beyond arm 112 and toward bore 56 with roller 140 pivotally motivating axle 125 and cam 150.

This first pulse also pivots pawl 110 to its FIG. 2 position—cam 150 remaining in its FIG. 6 position for the moment—so that ball 120 is urged by pawl surface 156 into arcuate recess 162 and allows ball 121 to move into pawl recess 117 and unlatch cam 150 for clockwise movement under the urging of weight 130 so that pin 175 drives rotor 70 through angle 101, whereupon cam 150 is latched against clockwise movement by engagement of ball 120 with the end of recess 162 opposite recess 161.

A second suitable pulse to solenoid 95 causes shaft 97 and pawl 110 to pivot through angle 99 in a clockwise direction and return to their FIGS. 6–8 position so that ball 121 is urged through bore 47 by pawl surface 156 into arcuate recess 163 and so that ball 120 is allowed to move through bore 47 into pawl recess 118 and unlatch cam 150 allowing inertial force acting on weight 130 to urge the weight further along axle 125 and pivotally motivate axle 125 and cam 150 in a clockwise direction and drive rotor 70 through angle 102, whereupon cam 150 is again latched against clockwise movement by engagement of ball 121 with the end of recess 163 opposite 161.

When solenoid 95 receives a third suitable pulse, shaft 97 and pawl 110 are again pivoted counter-clockwise through angle 99 so that ball 120 is urged by pawl surface 156 into arcuate recess 164 and allows ball 121 to again move into pawl recess 117 unlatching cam 150 for counter-clockwise movement so that rotor 70 is driven through angle 103, cam 150 then being latched against clockwise movement by engagement of ball 120 with the end of recess 164 opposite recess 161.

A fourth suitable pulse to solenoid 95 causes shaft 97 and pawl 110 to return again to their FIGS. 6–8 position so that ball 121 is urged through bore 47 by pawl surface 156 into arcuate recess 165 and so that ball 120 is allowed to move through bore 47 into pawl recess 118 and unlatch cam 150 so that weight 130 moves to its FIG. 2 position along axle 125 and pivotally motivates axle 125 and cam 150 in to drive rotor 70 through angle 104, whereupon cam 150 is again latched against clockwise movement by engagement of ball 121 with the end of recess 165 opposite recess 161.

A fifth suitable pulse to solenoid 95 again pivots shaft 97 and pawl 110 counter-clockwise through angle 99 so that ball 120 is urged by pawl surface 156 into spherical section recess 166 as shown in FIG. 2 and locks cam 150 against further pivotal movement, thereby also locking rotor 70 in its armed position as also shown in FIG. 2. When the rotor is so locked, it remains in the armed condition although weight 130 is no longer motivated in a direction toward surface 17 by inertial forces and is, in fact, motivated in the opposite direction by spring 138 or by inertia forces.

It is evident from the Figures and the above description that cam 150 engages the balls oppositely of shaft 97; that pawl 110 engages balls 120 and 121 oppositely of axle 125 and urge the balls to reciprocate in a direction between shaft 97 and axle 125 at each oscillation of the shaft; that balls 120 and 121 are mounted in portion 14 of body 10 between pawl 110 and cam 150 for movement from and partially into recess 117 and 118 of pawl 110 and recesses 161–166 of cam 150; that recess 117 and the recesses of each row 168 thereof are aligned axially of axle 125 with bore 46 for reception of ball 120; and that recess 118 and the recesses of each row 169 thereof are so aligned with bore 47 for reception of ball 121.

It is also evident that, during the shaft 97 oscillations, the configuration of pawl recesses 117 and 118 and of cam recesses 161–166 generates an escapement action wherein balls 120 and 121 alternately retain and release or unlatch cam 150 and, therefore, axle 125 so that the axle moves through actuating angle 147 in successive, predetermined pivotal movements which correspond individually to angles 101–104 and are motivated by inertial force acting on weight 130 as cam 150 is released by each of such oscillations. That is, the pawl recesses are configured so that balls 120 and 121 are alternately motivated by these recesses toward and from cam 150 by the oscillations of pawl 110 with shaft 97, and the cam recesses of rows 168 and 169 thereof are configured so that, when axle 125 is motivated by weight 130 and the balls are motivated by the pawl recesses, movement of the balls from the cam recesses unlatches the axle to pivot successively in steps corresponding to the shaft oscillations of shaft and to angles 101–104 and thereby drive rotor 70 towards its armed position.

It is further evident from FIGS. 5 and 9, that the respective lengths of recesses 162–165 are such that rotor 70 moves in three initial angular movements 101–103 from the safe position of the rotor toward its intermediate position, which is indicated by circle 81 and in which leads 75 are partially aligned with the corresponding detonators 31, and such that the rotor moves in its final angular movement 104 through this intermediate position toward and into the armed position.

When the safe and arm device is in the armed condition shown in FIG. 2 with rotor 70 in its armed position and with weight 130 disposed in bore 42 toward surface 17 and not subject to inertia forces toward this surface, and when it is desired to resafe the device by returning rotor 70 to its FIG. 3–5 safe position, the device may be resafed by application of a suitable and predetermined sequence of electrical pulses to solenoid 95 to cause shaft 97 and pawl 110 to pivot in a corresponding sequence of oscillations. The energy for resafing is provided by spring 138 which is compressed in such armed condition so as to motivate the weight along axle 125 in a direction toward bearing arm 50 and cause roller 40 to drive the axle through its actuating angle 147 and drive the rotor through its arming angle 77 in a direction counter-clockwise in FIGS. 3–4 and thus opposite the direction the direction the axle and rotor pivoted to place the safe and arm device in the armed condition. In resafing, the rotor is driven from the axle by engagement of pin 175 in slot 88 similarly to the manner in which the rotor was driven toward its armed condition. It is evident that a suitable sequence of such oscillations when weight 130 is motivated by spring 138 will cause balls 120 and 121 to successively unlatch cam 150 and allow axle 125 and rotor 70 to pivot in such opposite direction under the motivation of spring 138 until the rotor attains its safe position.

Obviously, many modifications and variations of the present invention are possible in light of the above teachings. It is, therefore, to be understood that the present invention may be practiced within the scope of the following claims other than as described herein.

What is claimed is:

1. In a safe and arm device having:

a body;

a rotor mounted on said body for pivotal movement through a predetermined arming angle from a safe position to an armed position; and a shaft pivotally mounted on said body and having a predetermined number of pivotal oscillations when said rotor is to pivot from said safe position to said armed position, the improvement comprising:

an axle mounted on said body for pivotal movement and extended parallel to said shaft;

a setback weight mounted on said body for movement along said axle by an inertial force acting on said weight when said rotor is to pivot from said safe position to said armed position;

means connecting said weight and said axle for driving said axle through a predetermined actuating angle as said weight moves a predetermined distance along said axle;

means connecting said axle and said rotor for driving said rotor from said axle through said arming angle as said axle pivots through said actuating angle;

a pair of escapement elements disposed between said shaft and said axle in spaced relation therealong;

means for mounting said escapement elements on said body for movement toward and from said shaft and said axle;

first cam means for urging said escapement elements in a reciprocating motion between said shaft and said axle at each of said oscillations, said first cam means being mounted on said shaft for pivotal oscillation therewith and engaging said escapement elements oppositely of said axle; and second cam means for alternately retaining said axle to each of said escapement elements and releasing said axle from each of said escapement elements at each of said oscillations in an escapement action such that said axle moves through said actuating angle in successive, predetermined pivotal movements motivated by said inertial force as said second cam means is released at each of said oscillations, said second cam means being mounted on said axle in engagement with said escapement elements oppositely of said shaft and moving pivotally with said shaft through said actuating angle.

2. The safe and arm device of claim 1 wherein:

said means for mounting said escapement elements comprises a pair of openings defined in said body, extended between said shaft and said axle, spaced axially thereamong, and individually receiving said escapement elements;

said first cam means comprises a first arcuate surface coaxially related to said shaft and juxtapositioned to said openings, said surface defining a pair of first recesses individually aligned axially of said shaft with said openings for reception of said escapement elements, and said first recesses being angularly spaced on said first arcuate surface for generating said reciprocating motion; and said second cam means comprises a second arcuate surface coaxially related to said axle, juxtapositioned to said openings axially of said axle, and defining a pair of rows of second recesses, said rows being individually aligned axially of said shaft with said openings for reception of said escapement elements and said second recesses of each of said rows being angularly spaced on said second arcuate surface for generating said escapement action.

3. The safe and arm device of claim 1 wherein:

said weight defines a bore extending centrally therethrough;

said axle is mounted on said body for pivotal movement about a predetermined axis and has a portion defining a generally cylindrical first surface extending along said axis and through said bore in slidable relation thereto, and a generally helical second surface contiguous with said cylindrical surface, elements of said second surface being parallel to a diameter of said first surface and intersecting a cylindrical helix coaxial therewith;

said means for driving said axle comprises a roller mounted on said weight for rotation about an axis parallel to a diameter of said first surface, and having a cylindrical peripheral surface engaging said second surface.

4. A safe and arm device comprising:

a cylindrical body having an end portion receiving a plurality of detonators and defining a plurality of explosive paths;

a rotor pivotally mounted in said end portion and defining a plurality of explosive leads, said rotor being movable to an armed position wherein said leads are disposed between said detonators and said paths;

a rotary solenoid having an output shaft motivated in a plurality of oscillations when said rotor is to move to said armed position;

an actuating shaft pivotally mounted on said body and having one end adjacent to said rotor, said actuating shaft extending from said one end alongside said output shaft;

means connecting said one end and said rotor for pivotally driving said rotor by pivotal movement of said actuating shaft;

a setback weight mounted on said actuating shaft for inertial motivated movement thereamong when said rotor is to move to said armed position;

helical means coupling said weight and said actuating shaft for motivating said actuating shaft pivotally when said weight is inertial motivated along said shaft;

an arcuate pawl having a pair of recesses and mounted on said output shaft for oscillation therewith;

an arcuate cam mounted on said actuating shaft for pivotal movement therewith and having a pair of rows of recesses, each of said rows being juxtapositioned to one of said recesses of said pawl; and a pair of latch balls mounted in said body between said pawl and said cam for movement from and partially into said recesses, each of said balls corresponding to one of said recesses of said pawl and to one of said rows; said recesses of said pawl being configured so that said balls are alternately motivated by said recesses of said pawl toward and from the cam by said oscillations; and said recesses of said rows being configured so that, when said actuating shaft is motivated by said weight and said balls are motivated by said recesses of said pawl, movement of said balls from said recesses of said rows unlatches said actuating shaft to pivot successively in steps corresponding to said oscillations and drive said rotor toward said armed position.

5. The safe and arm device of claim 4 wherein:

said rotor pivots through a predetermined arming angle from a safe position wherein said leads are not aligned with said paths to said armed position wherein said leads are fully aligned with said path, said leads being partially aligned with said paths in an intermediate position of said rotor adjacent to said armed position; and said means for connecting said one end of said actuating shaft and said rotor drives said rotor through said arming angle at an angular rate increasing as said rotor approaches said intermediate position and moves therefrom toward said armed position.

6. The safe and arm device of claim 4 wherein:

said rotor pivots from a safe position wherein said leads are not aligned with said paths to said armed position wherein said leads are fully aligned with said path, said leads being partially aligned with said paths in an intermediate position of said rotor adjacent to said armed position; and said recesses of said rows correspond to said steps and extend accurately along said cam for predetermined angles selected so that a plurality of initial said steps correspond to movement of said rotor from said safe position toward said intermediate position and so that a final one of said steps corresponds to movement of said rotor through said intermediate position toward said armed position.

7. The safe and arm device of claim 4 wherein said recesses of said cam are configured so that a predetermined sequence of said oscillations unlatches said actuating shaft to pivot through a predetermined actuating angle driving said rotor through a predetermined arming angle from a safe position of said rotor to said armed position thereof.

8. The safe and arm device of claim 7 wherein said inertial motivated movement of said weight motivates said actuating shaft pivotally in a predetermined direction through said actuating angle; and wherein the device further comprises resafing means for motivating said actuating shaft in a direction opposite said predetermined direction when said weight is not motivated by said inertial motivated movement, so that another predetermined sequence of said oscillations unlatches said actuating shaft to pivot oppositely of said predetermined direction through said actuating angle and drive said rotor from said armed position to said safe position when said actuating shaft is motivated by said resafing means.

* * * * *